US005321853A

United States Patent [19]

Onley

[11] Patent Number: 5,321,853

[45] Date of Patent: Jun. 21, 1994

[54] BASEBALL GLOVE WITH WEB-FRAME AND ANTI-GLARE SHIELD

[76] Inventor: Michael M. Onley, 142 E. Philadelphia St., York, Pa. 17403

[21] Appl. No.: 152,692

[22] Filed: Nov. 16, 1993

[51] Int. Cl.[5] ..... A41D 13/10

[52] U.S. Cl. ..... 2/19; 2/160

[58] Field of Search ..... 2/16, 19, 159, 160, 2/161.1, 15, 11, 161.7

[56] References Cited

U.S. PATENT DOCUMENTS

| | | | |
|---|---|---|---|
| 2,962,721 | 12/1960 | Espy | 2/11 |
| 3,623,163 | 11/1971 | Latina | 2/19 |
| 3,909,848 | 10/1975 | Brockman | 2/19 |
| 4,279,681 | 7/1981 | Klimezky | 156/245 |
| 4,453,272 | 6/1984 | Miyake et al. | 2/19 |
| 4,908,880 | 3/1990 | Clevenhagen | 2/19 |
| 4,928,320 | 5/1990 | Aoki | 2/19 |
| 4,996,721 | 3/1991 | Beshro | 2/19 |
| 5,012,529 | 5/1991 | Murai | 2/18 |

*Primary Examiner*—Clifford D. Crowder
*Assistant Examiner*—Michael A. Neas
*Attorney, Agent, or Firm*—Richard C. Litman

[57] ABSTRACT

A baseball glove, mitt, or the like having a lace attached web-frame. The web-frame encloses a readily replaceable anti-glare shield insert. Preferably, the web-frame is cruciform, so that the insert is reinforced and protected, there still being four windows provided for viewing an airborne ball. The shield filters intense visual light to allow increased visual perception, through the web, of a high fly ball against a sunny background or against a stadium's artificial lighting.

6 Claims, 4 Drawing Sheets

BASEBALL GLOVE WITH WEB-FRAME AND ANTI-GLARE SHIELD

BACKGROUND OF THE INVENTION

1. FIELD OF THE INVENTION

This invention relates to baseball gloves, and in particular to a baseball glove with a replaceable glare reducing transparent shield.

2. DESCRIPTION OF THE PRIOR ART

Unique to baseball is the situation of having to field a ball that is batted or thrown to an altitude at which there is difficulty in perceiving the ball's in-flight location because the ball gets lost in a bright background such as against the sun or against a stadium's high intensity field-illumination lights during night play.

The present invention concerns allowing the baseball glove wearer to sight an overhead ball, specifically through the web, to initiate ball-to-glove capture. In regard to this, U.S. Pat. No. 4,453,272, issued to Ichio Miyake et al. on Jun. 12, 1984, shows a thick semi-bendable anti-glare shield of which is made of an anti-glare material. This anti-glare shield is laced to the baseball glove and forms a permanent part of the baseball glove.

Other baseball glove web constructions have been made to improve a baseball glove's characteristics in retaining a ball. Examples of such web construction are shown in U.S Pat. Nos. 3,623,163, issued to Roland N. Latina on Nov. 30, 1971, and U.S. Pat. No. 4,908,880, issued to Robert L. Clevenhagen on Mar. 20, 1990. These patents show an improvement to the ball-retention capability of a baseball glovė, and an improved means of absorbing a greater amount of ball-to-glove impact energy, respectively. In both cases, the respective web constructions have openings that allow a limited amount of sight perception.

None of the above U.S. inventions and patents, taken either singly or in combination, is seen to describe the instant invention as claimed.

SUMMARY OF THE INVENTION

The anti-glare shield for the present invention is thin enough for easy long term baseball glove flexibility, yet still capable of sun or light protection with a minimal amount of visual distortion. The shield is made of a light filtering synthetic sheet material.

A cruciform reinforcing web retains and protects the anti-glare shield. The cruciform web creates quadrant windows, which arrangement bears some limited similarity to the web openings in the above cited art.

Accordingly, it is a principal object of the invention to provide a baseball glove with an anti-glare shield.

Another object is to provide a anti-glare shield which is manually inserted and removed from the glove.

It is another object of the invention to provide a baseball glove with a holder for the anti-glare shield that allows ready placement of a thin flexible anti-glare shield into the holder.

Still another object of the invention is to provide improved elements and arrangements thereof in an apparatus for the purposes described which is inexpensive, dependable and fully effective in accomplishing its intended purposes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
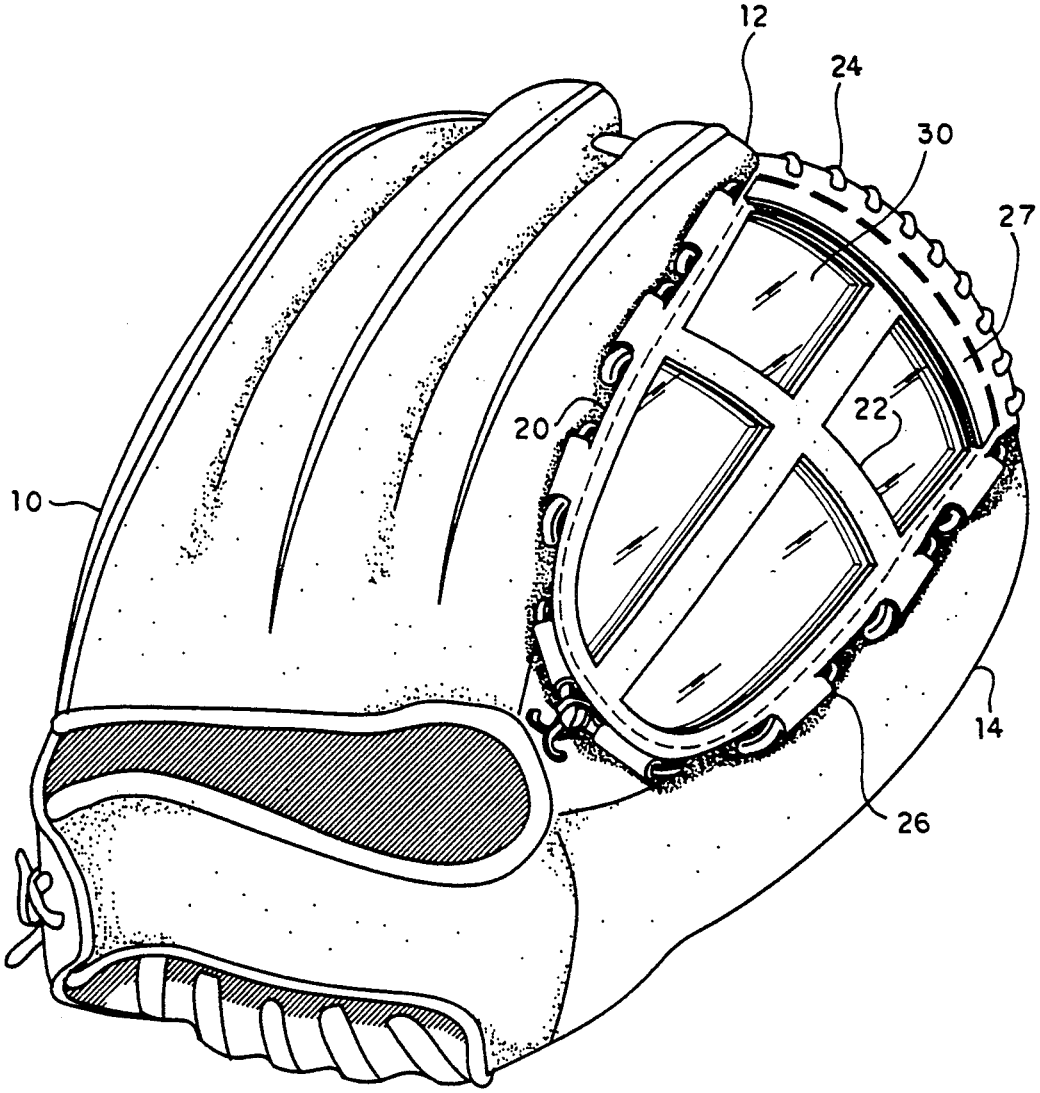
FIG. 1 is a rear perspective view of a novel baseball glove having anti-glare shield.
Figure 4:
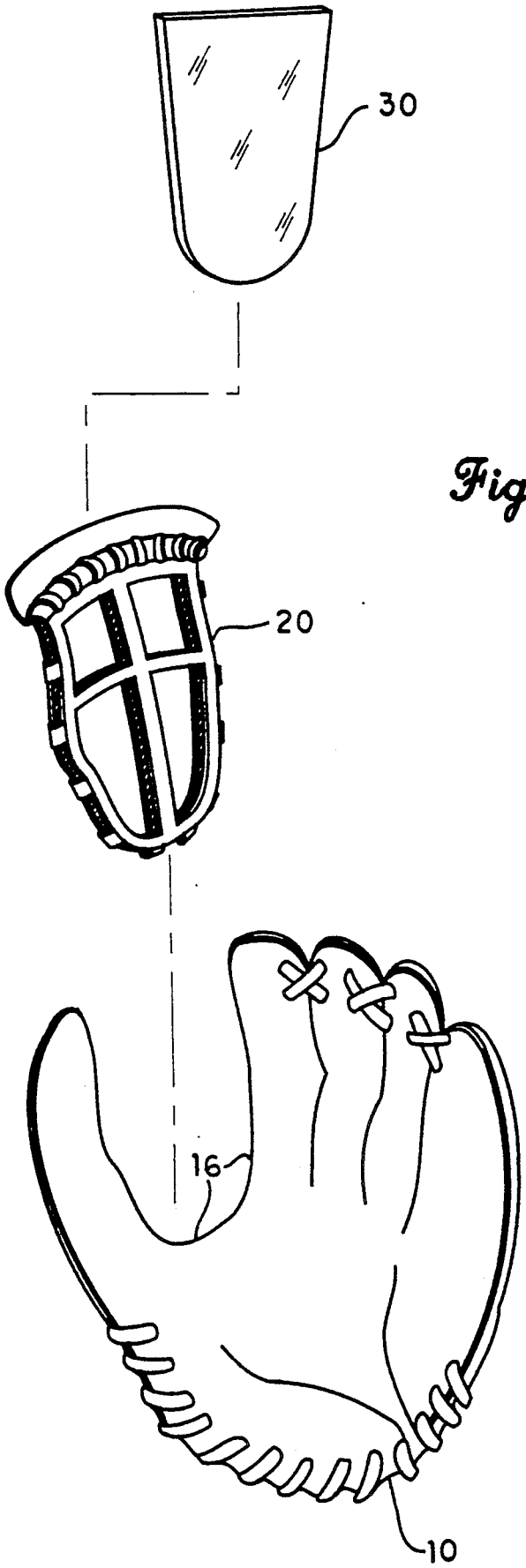
FIG. 4 is an exploded front perspective view of an anti-glare shield, the web-frame, and a baseball glove, drawn to reduced scale.

As illustrated in FIG. 1, the present invention is a baseball glove 10 with an anti-glare shield 30 enclosed in an web-frame 20. The web-frame 20 is made of a flexible material. The web-frame 20 has an U-shaped perimeter shaped to fit the length of the crotch portion 16 (see FIG. 4) between the baseball glove's forefinger stall 12 and the thumb stall 14. The top of the web-frame 20 has a portion which continues the above crotch portion 16 and extends along a line beginning and ending at the general apices formed by the baseball glove's forefinger stall 12 and thumb stall 14. The top of the web-frame 20 is linear, completes the web-frame 20, and is spirally bound at its outer margin by lace 24, made of baseball glove-making material.

Traditional materials for making gloves have included natural animal hides. However, any suitable material is acceptable for this purpose, provided it is strong, flexible, and absorbs the shock of catching a ball.

The web-frame 20 has a pair of cruciform strips 22 which mirror each other, separated by a distance equal to that accommodating the anti-glare shield's ingress into the web-frame 20. The cruciform strips 22 enable the web-frame 20 to absorb and transmit the impact energy of a caught ball to the rest of the baseball glove 10 and to protect the surface of an enclosed anti-glare shield 30.

The web-frame 20 has a slot 28 (see FIG. 2) that creates a single entrance to the web-frame 20, thereby providing an envelope for housing the anti-glare shield 30.

Figure 2:
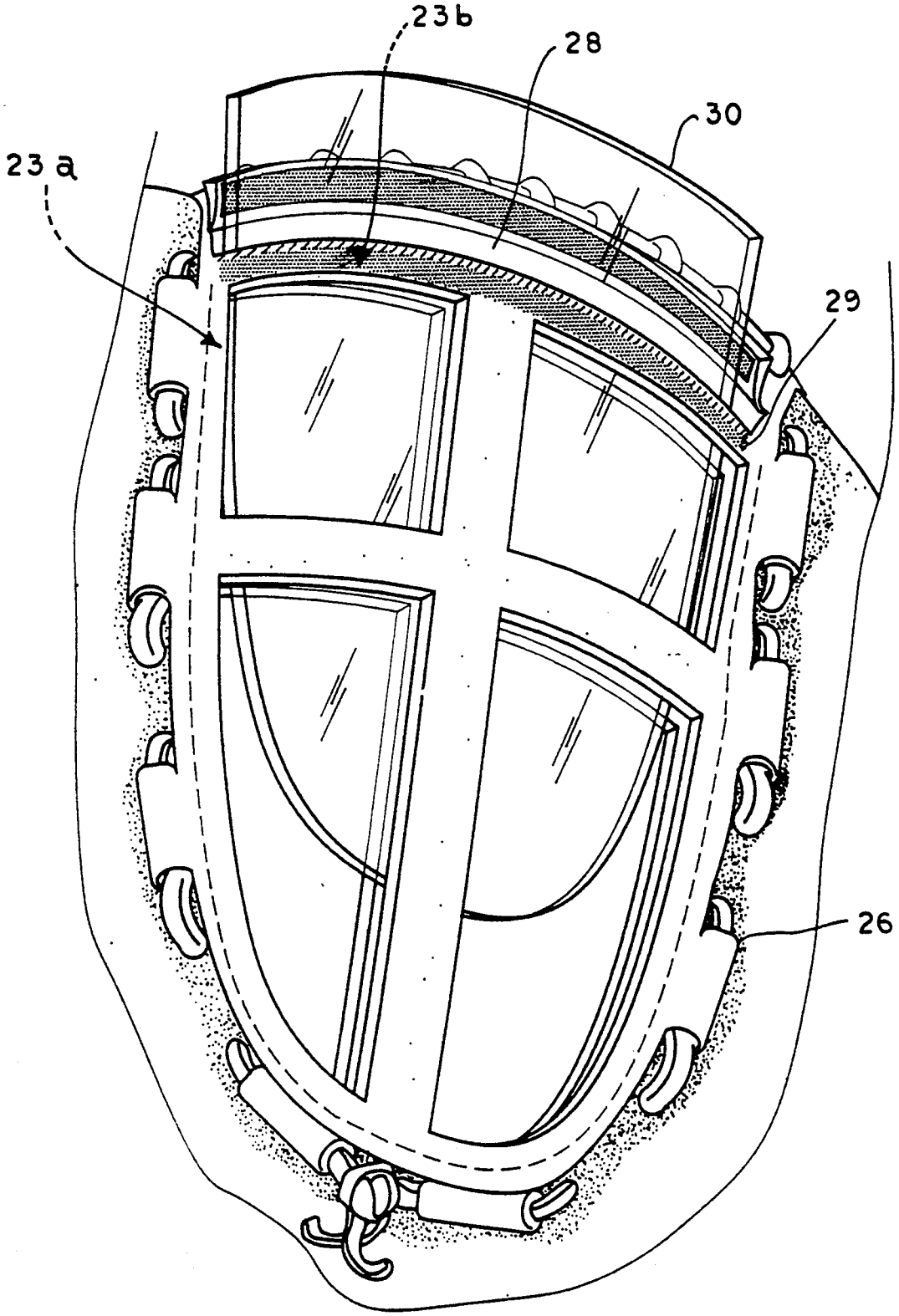
FIG. 2 is a perspective detail view of an anti-glare shield and its holder, further showing a preferred embodiment incorporating a retaining flap, drawn to enlarged scale.
Figure 3:
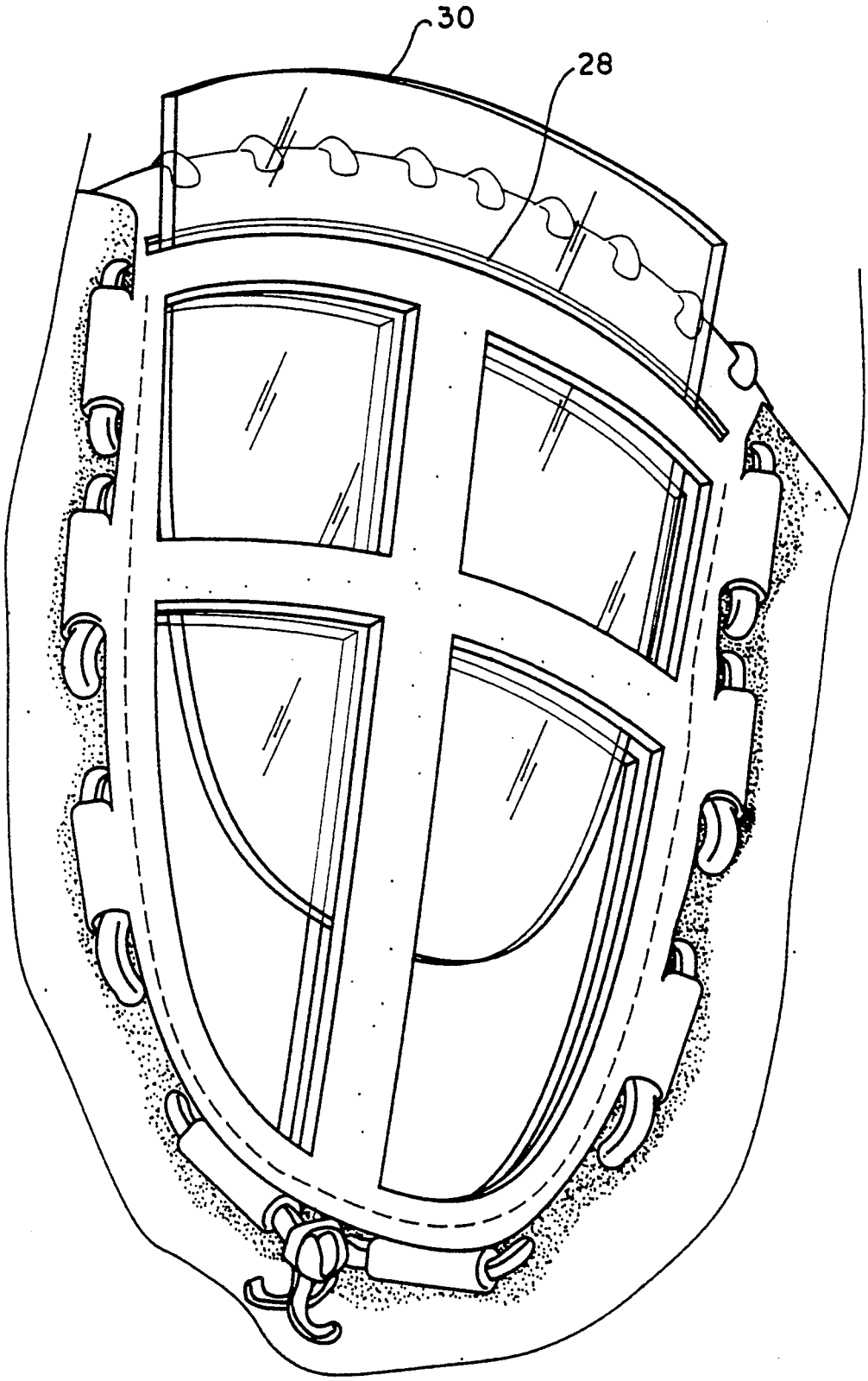
FIG. 3 is a perspective detail view of the anti-glare shield showing the anti-glare shield being inserted into the holder, and drawn to enlarged scale.

In the preferred embodiment (see FIG. 1), a flap 27, equal in length to the length of the slot 28, folds over the inserted anti-glare shield 30 and secures the anti-glare shield 30 in place by hook and loop fastener 29 (see FIG. 2). In an alternative embodiment (see FIG. 3), this flap 27 is omitted, and an anti-glare shield 30 is held in place by a friction fit.

The web-frame 20 has baseball glove attachment loops 26 along the outer perimeter of the U-shaped portion thereof, which is placed on the baseball glove's U-shaped crotch portion 16. A lace 24, made of baseball glove material, will interlace with the preexisting holes provided in the baseball glove along the crotch portion 16, and thus will hold the web-frame 20 in place to the baseball glove 10.

The shield 30 is made of a quasi-transparent anti-glare synthetic sheet material. As used herein, "quasi-transparent" will signify the characteristic that light passing through the material is reduced, so as to overcome glare. However, there is minimal visual distortion, as is traditionally associated with the term "translucent." The shield 30 is flexible, weather resistant, and of such a uniform planar thickness as to be tolerant of expected baseball glove 10 wear and tear, yet thin enough to readily slide through the slot 28 and into web-frame's envelope; and thin enough not to cause visual distortion of a ball or of the ball's ambient background. When the anti-glare shield 30 is in the web-frame 20, the anti-glare shield 30 is surrounded by a U-shaped envelope margin 23 (see FIG. 2); the envelope margin 23 includes a lower U-shaped envelope margin 23*a* and a linear top envelope margin 23*b*.

It is to be understood that the present invention is not limited to the embodiments described above, but encompasses any and all embodiments within the scope of the following claims.

I claim:

1. A baseball glove including an envelope for containing an anti-glare shield, said envelope comprising a web-frame and an anti-glare shield removably insertable into said web-frame, said envelope having means for attachment to said baseball glove;

said anti-glare shield having quasi-transparent properties, whereby said anti-glare shield filters visually intense light, said anti-glare shield being made from a material which is impervious to water, retains flexibility in ambient temperatures, and is thin and flexible;

said envelope having four sides, a first lower, U-shaped envelope margin providing an outer, perimetric boundary extending about three of said sides, and a second linear top envelope margin extending about the fourth of said four sides, thereby providing a closed perimeter;

said web-frame having two parallel cruciform-strips forming two planes which are uniformly separated and which define front and rear faces of said web-frame, said first lower, U-shaped envelope margin having a predetermined cross-section and outer perimeter;

said cruciform-strips having means providing continuous contact with said first lower, U-shaped envelope margin, thereby defining said envelope and providing quadrant windows in said front and rear faces;

said second linear top envelope margin having means defining a slot providing an entrance to said envelope, and said means for attachment of said envelope to said baseball glove comprising attachment loops located at intervals along said outer perimeter of said lower U-shaped envelope margin.

2. The baseball glove according to claim 1, wherein said web-frame is made from natural animal hide.

3. The baseball glove according to claim 1, wherein said web-frame is made from artificial, flexible material.

4. The baseball glove according to claim 1, said web-frame having a flap above said slot, said flap and said web-frame having hook and loop fastener disposed thereon, whereby said flap entraps said anti-glare shield within said envelope, and said flap is constrained against detachment from said web-frame.

5. The baseball glove according to claim 1, said anti-glare shield further being configured and dimensioned to be slidably inserted into and removed from said envelope, and to be retained therein by snug fit.

6. A baseball glove including an envelope for containing an anti-glare shield, said envelope comprising a web-frame and an anti-glare shield removably insertable into said web-frame, said envelope having means for attachment to said baseball glove;

said anti-glare shield having quasi-transparent properties, whereby said anti-glare shield filters visually intense light, said anti-glare shield being made from a material which is impervious to water, retains flexibility in ambient temperatures, and is thin and flexible;

said envelope having four sides, a first lower, U-shaped envelope margin providing an outer, perimetric boundary extending about three of said sides, and a second linear top envelope margin extending about the fourth of said four sides, thereby providing a closed perimeter;

said web-frame having two parallel cruciform-strips forming two planes which are uniformly separated and which define front and rear faces of said web-frame, said first lower, U-shaped envelope margin having a predetermined cross-section and outer perimeter;

said cruciform-strips having means providing continuous contact with said first lower, U-shaped envelope margin, thereby defining said envelope and providing quadrant windows in said front and rear faces;

said second linear top envelope margin having means defining a slot providing an entrance to said envelope, and said means for attachment of said envelope to said baseball glove comprising attachment loops located at intervals along said outer perimeter of said lower U-shaped envelope margin, said web-frame further including a flap located above said slot, whereby said anti-glare shield is entrapped within said envelope.

* * * * *